US012708936B2

(12) United States Patent
De Sutter

(10) Patent No.: US 12,708,936 B2
(45) Date of Patent: Aug. 18, 2026

(54) SYSTEM FOR ACCURATELY PUNCHING HOLES IN A PROFILE AND ITS METHOD

(71) Applicant: SOENEN TECHNOLOGY NV, Roeselare (BE)

(72) Inventor: Luc De Sutter, Roeselare (BE)

(73) Assignee: SOENEN TECHNOLOGY NV, Roeselare (BE)

( * ) Notice: Subject to any disclaimer, the term of this patent is extended or adjusted under 35 U.S.C. 154(b) by 460 days.

(21) Appl. No.: 18/245,662

(22) PCT Filed: Sep. 21, 2021

(86) PCT No.: PCT/EP2021/075871

§ 371 (c)(1),
(2) Date: Mar. 16, 2023

(87) PCT Pub. No.: WO2022/063745

PCT Pub. Date: Mar. 31, 2022

(65) Prior Publication Data

US 2023/0356281 A1 Nov. 9, 2023

(30) Foreign Application Priority Data

Sep. 22, 2020 (BE) ..... 2020/5650

(51) Int. Cl.
*B21D 28/24* (2006.01)

(52) U.S. Cl.
CPC ..... *B21D 28/243* (2013.01)

(58) Field of Classification Search
CPC ..... Y10T 83/0481; Y10T 83/175; Y10T 83/5669; Y10T 83/5815; Y10T 83/647;
(Continued)

(56) References Cited

U.S. PATENT DOCUMENTS 3,391,593 A * 7/1968 Jordan ..... B21D 28/243 475/263
3,667,333 A 6/1972 Flynn, Jr.
3,892,154 A * 7/1975 Duffy ..... B26D 5/12 83/639.1

FOREIGN PATENT DOCUMENTS

DE 2420655 A1 11/1975
DE 2638059 A1 3/1978
(Continued)

OTHER PUBLICATIONS

ISR-WO from parent application PCT/EP2021/075871 dated Jan. 4, 2022.

*Primary Examiner* — Phong H Nguyen
(74) *Attorney, Agent, or Firm* — Vorys, Sater, Seymour and Pease LLP

(57) ABSTRACT

The current invention relates to a system for accurately punching holes in a profile comprising at least one clamp, slideable in a first direction, and at least one punch unit for punching holes in the profile, wherein the at least one clamp comprises a linear encoder, configured for measuring a displacement in the first direction of the at least one clamp. The invention also relates to a method for accurately punching holes in a profile comprising clamping a profile in a clamp, displacing the profile by sliding the clamp in a first direction in a punch unit, and punching at least one hole in the profile by the punch unit, wherein the displacement of the profile in the first direction is measured with a linear encoder, coupled to the clamp.

11 Claims, 1 Drawing Sheet

(58) Field of Classification Search
CPC . Y10T 83/6492; Y10T 83/727; Y10T 83/748; Y10T 83/7487; Y10T 83/7593; B21D 28/243; B21D 28/265; B21D 28/02; B21D 28/24; B21D 28/34; B21D 43/006; B21D 43/10; B26D 2007/013; B26D 5/00; B26D 5/005; B26D 5/007
See application file for complete search history.

(56) References Cited

FOREIGN PATENT DOCUMENTS

| | | | | |
|---|---|---|---|---|
| DE | 157673 | A | | 12/1982 |
| JP | H11333534 | A | | 12/1999 |
| JP | 2020015130 | A | | 1/2020 |
| KR | 20010059425 | A | | 7/2001 |
| KR | 20100034879 | A | * | 4/2010 |
| WO | 2020239377 | A1 | | 12/2020 |
| WO | 2022/063745 | A1 | | 3/2022 |

* cited by examiner

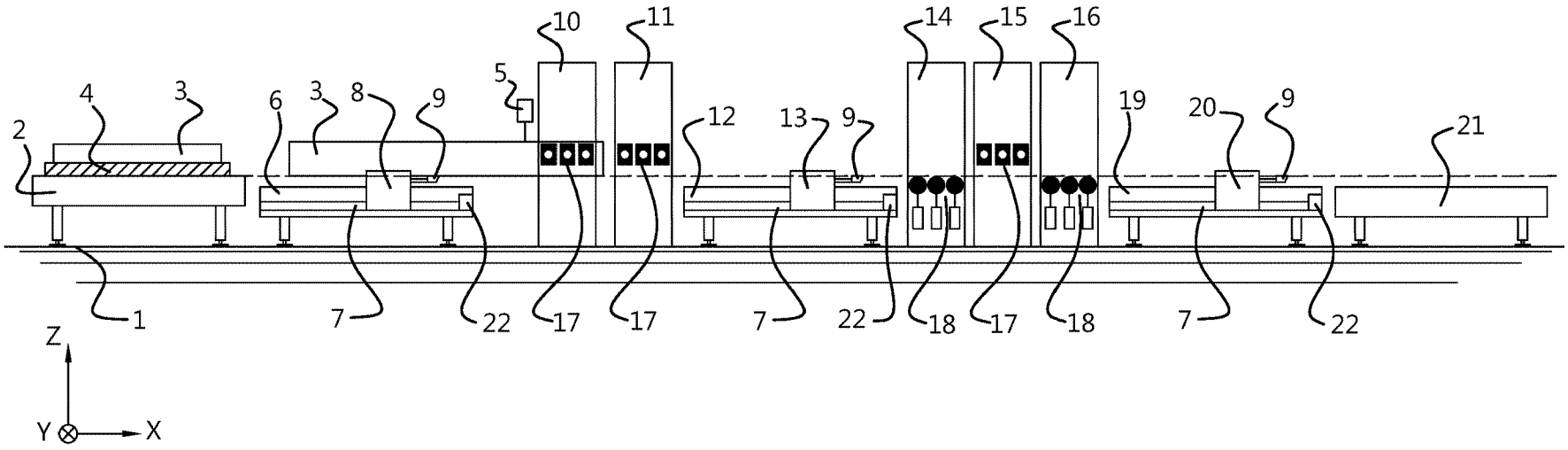
21
22
9
20
7
19
16
18
15
17
14
18
22
9
13
7
12
11
17
10
17
5
22
9
8
7
3
6
3
4
1
2
Z
X
Y

SYSTEM FOR ACCURATELY PUNCHING HOLES IN A PROFILE AND ITS METHOD

FIELD OF THE INVENTION

The present invention relates to a system for accurately punching holes in a profile.

In a second aspect, the present invention also relates to a method for accurately punching holes in a profile.

In another aspect, the present invention also relates to a use of a system according to the first aspect or a method according to the second aspect for punching holes in web and flanges of a U-profile for a truck or trailer chassis.

BACKGROUND

Punch lines for punching holes in elongated profiles are known from the state of the art. A punch line comprises at least one punch unit and at least a feeding device for displacing the profile along the punch line to and through the punch unit. The feeding device is driven by a servomotor through a transmission. The position of the feeding device along the punch line is measured with a rotary encoder on the axle of the servomotor.

Punch lines are for instance used for producing beams of a truck or trailer chassis. The beams are made from U-profiles. The chassis of the truck or trailer consists mainly of two U-profiles in the longitudinal direction of the truck or trailer. The opening of the U-profiles are facing each other. The U-profiles are connected with several cross-beams. Connections are with bolts or rivets. Holes have to be foreseen in the U-profiles for said connections.

On the truck or trailer chassis, different parts and accessories have to be fixed. Examples of parts and accessories are the engine, wheel units, fuel tank, . . . . During the assembly of the truck or the trailer all these parts and accessories are fixed to the chassis with bolts or rivets. Again holes in the U-profiles are required. In the particular case of a heavy truck, often a reinforcement U-profile is inserted inside the beams and has to be connected to said beams with bolts and rivets.

Many holes are to be punched in the U-profiles. Many of these holes are positioned in the web of the U-profiles. Also a reasonable amount of holes are to be punched in the flanges of the U-profiles. These holes can have different diameters.

The relative positions of the holes are very important to avoid distortions in the chassis of the truck for good road holding. The accuracy of the hole positions is also important for easy assembly of the chassis.

A punch line according to the state of the art is not suited for accurately punching holes in a profile. Firstly, a rotary encoder on the axle of the servomotor results in a limited accuracy of the position of the feeding device along the punch line. The rotary encoder measures the rotary movement of the servomotor. This rotary movement is translated in a linear movement by a transmission. A transmission can be composed of a belt, ball screw or a gear with gear rack. A transmission is constructed with mechanical tolerances. These tolerances result in errors in the position of the feeding device, that are not measured by the rotary encoder.

Secondly, U-profiles do have tolerances. The width of the U-profile can vary from the specified width. The U-profiles are not necessarily perfectly straight. The U-profiles can have camber and bow. The U-profiles can have torsion along its length. To avoid distortions in the chassis of the truck or trailer and for easy assembly, it is required that the hole positions should follow the camber or bow. This cannot be controlled with a punch line depending on a rotary encoder for positioning the feeding device.

Known punch lines are described in WO 2020/239377, JP 2020 015130, JP H11 333534, DE 26 38 059 and U.S. Pat. No. 3,667,333.

The present invention aims to resolve at least some of the problems and disadvantages mentioned above.

SUMMARY OF THE INVENTION

The present invention and embodiments thereof serve to provide a solution to one or more of above-mentioned disadvantages. To this end, the present invention relates to a system for accurately punching holes in a profile according to claim 1.

The system comprises at least one clamp unit, comprising a clamp, slideable in a first direction, and at least one punch unit for punching holes in the profile. The at least one clamp unit comprises a linear encoder, configured for measuring a displacement of the clamp of the at least one clamp in the first direction. The linear encoder measures directly the displacement of the clamp in the first direction. This is beneficial because errors in the displacement in the first direction of the clamp, caused by tolerances in mechanical components, are included in the measurement. Said errors are not ignored or are not estimated as when using a rotary encoder. Said errors can therefore be corrected by adjusting the displacement of the clamp. A higher accuracy of the position of the clamp and consequently the holes can be obtained compared to a punch line according to the state of the art.

The clamp unit comprises a temperature sensor for measuring the temperature of the linear encoder. This is beneficial because the temperature of the linear encoder can vary depending on the temperature in the workshop. It results in expansion or compression of the linear encoder in function of temperature, resulting in measuring errors. By knowing the temperature of the linear encoder, the expansion or compression can be calculated and the measuring error compensated for.

More particular, the method as described herein provides that a profile is clamped in a clamp of a clamp unit, displaced in a punch unit by sliding the clamp in a first direction, and punching at least one hole in the profile by the punch unit, wherein the displacement of the profile in the first direction is measured with a linear encoder, comprised in the clamp unit. This is beneficial because a linear encoder measures directly the displacement of the clamp in the first direction. Therefore errors in the displacement in the first direction of the clamp, caused by tolerances in mechanical components, can be corrected by adjusting the displacement of the clamp.

The displacement measurement with the linear encoder is according to this embodiment temperature compensated. This is advantageous because the linear encoder can expand or compress depending on the temperature in the workshop, what results in measurement errors. By knowing the temperature of the linear encoder, the expansion or compression can be calculated and the measurement can be temperature compensated.

The use as described herein provides an advantageous effect that holes punched in web and flanges of a U-profile for a truck or trailer chassis are accurately positioned. This is advantageous for avoiding distortions in the chassis of the truck or trailer and for easy assembly.

DESCRIPTION OF FIGURES

FIG. 1 shows a schematic overview of a punch line comprising a system according to an embodiment of the present invention.

DETAILED DESCRIPTION OF THE INVENTION

Unless otherwise defined, all terms used in disclosing the invention, including technical and scientific terms, have the meaning as commonly understood by one of ordinary skill in the art to which this invention belongs. By means of further guidance, term definitions are included to better appreciate the teaching of the present invention.

As used herein, the following terms have the following meanings:

"A", "an", and "the" as used herein refers to both singular and plural referents unless the context clearly dictates otherwise. By way of example, "a compartment" refers to one or more than one compartment.

"Comprise", "comprising", and "comprises" and "comprised of" as used herein are synonymous with "include", "including", "includes" or "contain", "containing", "contains" and are inclusive or open-ended terms that specifies the presence of what follows e.g. component and do not exclude or preclude the presence of additional, non-recited components, features, element, members, steps, known in the art or disclosed therein.

Furthermore, the terms first, second, third and the like in the description and in the claims, are used for distinguishing between similar elements and not necessarily for describing a sequential or chronological order, unless specified. It is to be understood that the terms so used are interchangeable under appropriate circumstances and that the embodiments of the invention described herein are capable of operation in other sequences than described or illustrated herein.

The recitation of numerical ranges by endpoints includes all numbers and fractions subsumed within that range, as well as the recited endpoints.

Whereas the terms "one or more" or "at least one", such as one or more or at least one member(s) of a group of members, is clear per se, by means of further exemplification, the term encompasses inter alia a reference to any one of said members, or to any two or more of said members, such as, e.g., any ≥3, ≥4, ≥5, ≥6 or ≥7 etc. of said members, and up to all said members.

Reference throughout this specification to "one embodiment" or "an embodiment" means that a particular feature, structure or characteristic described in connection with the embodiment is included in at least one embodiment of the present invention. Thus, appearances of the phrases "in one embodiment" or "in an embodiment" in various places throughout this specification are not necessarily all referring to the same embodiment, but may. Furthermore, the particular features, structures or characteristics may be combined in any suitable manner, as would be apparent to a person skilled in the art from this disclosure, in one or more embodiments. Furthermore, while some embodiments described herein include some but not other features included in other embodiments, combinations of features of different embodiments are meant to be within the scope of the invention, and form different embodiments, as would be understood by those in the art. For example, in the following claims, any of the claimed embodiments can be used in any combination.

In the context of this document a profile extends into a longitudinal direction. A profile has a transverse cross-section, mostly invariant between its two end portions. A profile comprises a base. The base is a central substantially flat surface of the profile. Generally the base is the biggest surface of the profile. The profile can comprise additional walls at sides of the base or on the surface of the base.

In the context of this document a U-profile is a profile with a cross-section in the shape of a letter U. The U-profile comprises a base, called web, and at each side of the base a side wall, called flange. The flanges are substantially perpendicular to the base. The flanges of the U-profile extend in the same direction.

In the context of this document a L-profile is a profile with a cross-section in the shape of a letter L. The L-profile comprises a first wall and a second wall, perpendicular to each other. The wall having the biggest surface is the base of the profile.

In the context of this document, camber is a deviation wherein the profile is not perfectly straight, but bends along the longitudinal direction in a plane formed by the base of the profile. In case of a U-profile the base is the web, so the profile bends in a plane defined by the web.

In the context of this document, bow is a deviation wherein the profile is not perfectly straight, but bends along the longitudinal direction in a plane, perpendicular to the plane formed by the base side of the profile. In case of a U-profile the base is the web, so the profile bends in a plane perpendicular to the web.

In a first aspect, the invention relates to a system for accurately punching holes in a profile.

In a preferred embodiment the system comprises at least one clamp unit and at least one punch unit for punching holes in the profile. The system is placed on a floor surface. The at least one clamp unit comprises a clamp and a support structure. The clamp of the at least one clamp unit is positioned on the support structure. The support structure comprises a longitudinal axis, wherein said longitudinal axis is substantially parallel with the floor surface. This longitudinal axis will be denoted as X-axis in the context of this document. An axis perpendicular to the X-axis and parallel with the floor surface will be denoted as Y-axis and an axis perpendicular to the plane formed by the X-axis and Y-Axis will be denoted with Z-axis in the context of this document. The support structure comprises a first and a second end. The at least one punch unit is positioned at the second end of the support structure. The clamp of the at least one clamp unit is slideable in a first direction. This first direction corresponds with the direction of the X-axis. The clamp is configured for displacing the profile along the X-axis in the punch unit, wherein the profile extends into a longitudinal direction and wherein said longitudinal direction is parallel with the X-axis. This enables the system to punch holes in the profile at different positions along said profile.

The at least one clamp unit comprises a linear encoder, configured for measuring a displacement of the clamp of the at least one clamp unit in the first direction. The linear encoder extends in the first direction, along the X-axis. The linear encoder is preferably attached to the support structure. The linear encoder has a minimal measurement accuracy along the X-axis of ±0.04 mm, preferably ±0.03 mm, more preferably ±0.02 mm and even more preferably ±0.01 mm. Preferably the linear encoder has a measuring range at least equal to a maximum possible displacement of the clamp. The measuring range is defined as the distance between a lowest and highest possible output of the linear encoder. A linear encoder is advantageous for accurately positioning the clamp of the at least one clamp unit in reference to the at least one punch unit and consequently accurately punching holes along the profile. The linear encoder measures directly the displacement of the clamp in the first direction. Errors in the displacement in the first direction of the clamp, caused by tolerances in mechanical components, are included in the measurement. Said errors are not ignored or are not estimated as when using a rotary encoder. Said errors can therefore be corrected by adjusting the displacement of the clamp.

In an embodiment the support structure comprises a servomotor configured for displacing the clamp. The clamp is coupled to the servomotor using a transmission. The transmission comprises a belt, gear with gear rack, a ball screw spindle or another suitable means for translating rotational motion of the servomotor to linear motion of the clamp. Preferably the transmission comprises a ball screw spindle. A ball screw is advantageous because it introduces little friction and because it can be assembled with high precision, allowing accurate positioning of the clamp.

In an embodiment the clamp can be displaced in the first direction over a length of at least 2 m, preferably at least 3 m. This is beneficial to punch holes in an elongated profile.

In an embodiment the system comprises an infeed conveyor. The infeed conveyor extends along the X-axis. The infeed conveyor is placed on the floor surface at the first end of the support structure of the at least one clamp unit. The infeed conveyor comprises a conveyor belt configured for supporting and displacing the profile in the first direction to the at least one clamp unit, wherein the profile extends into a longitudinal direction and wherein said longitudinal direction is parallel with the X-axis. Preferably the infeed conveyor comprises a series of rollers distributed along the X-axis. Preferably at least a part of the rollers are driven rollers. Preferably the series of rollers is distributed more dense along the X-axis near the first end of the support structure of the at least one clamp unit. This is beneficial to have a better support of a profile when being clamped by the at least one clamp. The system comprises preferably a first sensor for detecting a beginning of the profile. Said beginning is an end of the profile, in the longitudinal direction of the profile, closest to the first end of the support structure of the at least one clamp unit. The sensor is advantageous to control the displacement of the profile by the infeed conveyor such that said beginning is presented to the clamp of the at least one clamp unit at a known position along the X-axis. In this way a reference is set in a direction along the X-axis. Said first sensor is preferably positioned close to the at least one punch unit. This is beneficial to reduce possible errors in setting a reference along the X-axis relative to the punch unit. Preferably the system comprises a second sensor, at short distance of said first second, to detect the beginning of the profile. The second sensor is at a distance of maximum 5 cm, preferably maximum 4 cm, more preferably maximum 3 cm, even more preferably maximum 2 cm and even more preferably maximum 1 cm. The second sensor is beneficial to set a reference in a direction along the X-axis after the at least one clamp clamped the profile. This could change the position of the profile slightly, what can be adjusted immediately by moving the profile over a minimum distance with the at least one clamp until the beginning of the profile is detected. A corrected reference in a direction along the X-axis is set.

In an embodiment the infeed conveyor has a length of at least 5 m, preferably at least 7 m, more preferably at least 8 m, even more preferably at least 9 m. This is beneficial for supporting and displacing elongated profiles in the first direction to the at least one clamp unit. This is especially beneficial for profiles used as beam for the chassis of a truck or trailer.

In an embodiment the system comprises at least two clamps units. Said clamp units are similar to a clamp unit described in a previous embodiment. A first support structure of a first clamp unit, supporting a first clamp, is identical to the support structure described in a previous embodiment. A second support structure of a second clamp unit, supporting a second clamp, is positioned in line, along its longitudinal axis, with the first support structure. The at least two clamps are slideable in the first direction. At least one punch unit is positioned in between the at least two clamp units. The at least one punch unit is positioned between the second end of the first support structure and the first end of the second support structure. The first clamp is configured for displacing the profile along the X-axis in the at least one punch unit, wherein the profile extends into a longitudinal direction and wherein said longitudinal direction is parallel with the X-axis. The second clamp is configured for displacing the profile along the X-axis out the at least one punch unit. Each of the at least two clamp units comprises a linear encoder, configured for measuring a displacement of the clamp of the at least two clamps in the first direction. The linear encoders are similar as described in a previous embodiments. The linear encoders have the same advantages as the linear encoder of a previous embodiment.

A system according the current embodiment is advantageous for creating a continuous punch line, wherein profiles are fed by the first clamp unit and removed by the second clamp unit. The embodiment is also advantageous when it is required to punch holes over substantially the whole length of the profile. In that case it is not possible to clamp the profile with the first clamp on a position not requiring punching holes. By taking over the profile with the second clamp, the first clamp can be released and holes can be punched in the profile on the position previously covered by the first clamp. Because both the first clamp unit and the second clamp unit comprise linear encoders, holes remain accurately punched along the X-axis after the profile has been taken over by the second clamp.

It is for a person of ordinary skill in the art clear that additional punch units can be positioned between the first and second clamp unit. It is for a person of ordinary skill in the art also clear when multiple punch units are positioned between the first and second clamp unit, said multiple punch units can extend along the X-axis over a length longer than the length of a profile, requiring one or more additional clamp units in between the first and second clamp unit. Said one or more additional clamp units are similar to clamp units described in the current and previous embodiments. Said one or more additional clamp units comprise a linear encoder. The support structures of said one or more additional clamp units are positioned in line, along their longitudinal axis, with the first support structure. The clamps of said one or more additional clamp units are slideable in a first direction.

In a preferred embodiment, a clamp unit comprises a temperature sensor configured for measuring the temperature of the linear encoder. The temperature sensor is placed directly on the linear encoder or near the linear encoder, for instance on the support structure of the clamp unit. When the linear encoder is mounted on the support structure and the temperature sensor is placed near the linear encoder on the support structure, the correct temperature will be measured as the support structure and the linear encoder will be at the same temperature. The temperature sensor is beneficial because the temperature of the linear encoder can vary depending on the temperature in the workshop. The linear encoder will expand or compress in the first direction in function of temperature, resulting in measuring errors. By knowing the temperature of the linear encoder, the expansion or compression can be calculated and the measuring error compensated for.

In a further embodiment the linear encoder is firmly attached to the support structure at a first end and moveable attached in the first direction at a second end. This is especially advantageous when the linear encoder and the support structure are fabricated from different materials with different thermal expansion coefficients. When temperature changes, the support structure and the linear encoder will expand or compress differently, resulting in stress in the material of the linear encoder. The linear encoder could bend. This will result in measuring errors. The linear encoder will expand or compress the most along its length. This corresponds with the first direction or along the X-axis. Because the linear encoder is moveable attached in the first direction at the second end, the linear encoder can expand or compress freely and no stress in the material of the linear encoder will occur. Due to the presence of the temperature sensor, the accuracy of the measurements of the linear encoder remains the same.

In an embodiment a clamp unit comprises a slippage sensor configured for detecting slippage of the profile in the clamp of the clamp unit. The slippage sensor is especially useful in two situations. A first situation occurs when the profile hits for instance a punch unit when being displaced into the punch unit. This can happen when the profile has camber or bow. Due to hitting the punch unit, the profile slips a little bit in the clamp unit and although the position of the clamp is still accurately known, the position of the profile against the reference is lost. It is not any longer possible to accurately punch holes in the first direction in the profile and corrective measures have to be taken. A second situation occurs when the profile hits for instance a second clamp while being clamped by a first clamp during take over. The consequences are similar as in the first situation.

In a further preferred embodiment the slippage sensor comprises an arm, having a first and a second end. The arm is connected at the first end to an attachment point on the clamp. The arm comprises a magnet at the second end, configured for magnetic attraction to the profile. The magnet is preferably an electromagnet. This is beneficial because the magnet can be attached to a and removed from the profile by manipulating a current through the electromagnet. The magnet is moveable relative to the attachment point on the clamp. The slippage sensor comprises means for measuring displacement of the magnet in the first direction.

In an embodiment the arm is rotatable around an axis parallel to the Z-axis and through the attachment point on the clamp. After the clamp clamps the profile, the arm rotates from a first position, wherein the magnet is above the clamp, to a second position, wherein the magnet is above the profile. The magnet is attracted to the profile, in case of an electromagnet, by activating a current. Because the profile is clamped in the clamp, the magnet will move towards the profile. For that purpose the arm is also rotatable around an axis in a plane parallel with the X-axis and Y-axis. A position of the magnet on the profile after being attracted to the profile is a magnet reference position. When the profile slips in the clamp, the arm will rotate around the axis parallel to the Z-axis and through the attachment point on the clamp. The magnet will move from the magnet reference position to a new position. The means for measuring displacement of the magnet in the first direction will measure the displacement in the first direction between the magnet reference position and the new position. This is a measure for the amount of slippage of the profile in the clamp. The position of the profile in the first direction can be automatically corrected.

In an alternative embodiment the arm is rotatable around an axis parallel with the Y-axis. After the clamp clamps the profile, the arm rotates from a first position, wherein the magnet is above the profile, to a second position, wherein the magnet is on the profile. The magnet is attracted to the profile. The magnet is slideably attached to the arm. When the profile slips in the clamp, the magnet will slide along the arm. The means for measuring displacement of the magnet in the first direction will measure the displacement of the magnet in the first direction. The position of the profile in the first direction can be automatically corrected.

In another alternative embodiment the arm is slideably attached in the first direction at its first end to the attachment point. The magnet is moveably attached in a direction along the Z-axis to the second end of the arm. After the clamp clamps the profile, the arm moves linearly from a first position, wherein the magnet is above the clamp, to a second position, wherein the magnet is above the profile. The magnet is attracted to the profile, in case of an electromagnet, by activating a current. The magnet moves linearly along the Z-axis until the magnet is on the profile. When the profile slips in the clamp, the arm will move relative to the attachment point on the clamp in the first direction. The means for measuring displacement of the magnet in the first direction will measure the displacement of the magnet in the first direction. The position of the profile in the first direction can be automatically corrected.

It is for a person of ordinary skill in the art clear that in the previously described embodiments of a slippage sensor comprising a magnet, the magnet can also be positioned under the clamp or next to the clamp. It is for a person of ordinary skill in the art clear that elements of the previously described embodiments of a slippage sensor comprising a magnet can be combined.

In an embodiment a punch unit comprises a displacement sensor. The displacement sensor is configured for measuring the displacement of the profile in a direction transverse to the first direction. This is advantageous for punching holes accurately in a profile with camber or bow. When having camber or bow, the holes would be very accurately positioned in the first direction, corresponding with the direction of the X-axis, but not in a direction transverse to the first direction. For instance, in case of a U-profile, whereby the web of the U-profile is in a plane parallel to the plane formed by the X-axis and Y-axis, holes in the web of the U-profile would not be accurately positioned in the direction of the Y-axis when having camber and holes in the flanges of the U-profile would not be accurately positioned in the direction of the Z-axis when having bow. Because the displacement of the profile in said direction transverse to the first direction can be measured with the displacement sensor, corrective actions can be taken and an accurate position of holes in said direction transverse to the first direction can be obtained.

In a further embodiment the displacement sensor comprises a group of at least three measuring pins or measuring rolls, preferably four measuring pins or measuring rolls, more preferably five measuring pins or measuring rolls and even more preferably six measuring pins or measuring rolls. Each measuring pin or measuring roll is coupled to a linear encoder. The linear encoder is configured to measure a linear displacement of the measuring pin or measuring roll. The linear encoder has a minimal measurement accuracy along said direction transverse to the first direction of ±0.04 mm, preferably ±0.03 mm, more preferably ±0.02 mm and even more preferably ±0.01 mm. The linear encoder has a measuring range from 0 mm to at least 200 mm, preferably at least 300 mm, more preferably at least 400 mm, even more preferably at least 500 mm. Preferably the linear encoder has a measuring range from 0 mm to at least equal to a maximum difference between positions of flanges and/or web of different profiles to be punched by the punch unit. The measuring range is defined as the distance between a lowest and highest possible output of the linear encoder. The measuring pins or measuring rolls of a group are equidistantly spread along an axis in the first direction. The group is positioned at a passage for the profile. Preferably the group is positioned at a passage where the profile passes between die shoes of the punch unit. This is advantageous because the displacement sensor measures the displacement of the profile in said direction transverse to the first direction close to the position according the first direction where the holes have to be punched. This results in small measurement errors and accurate positioning of the holes in said direction transverse to the first direction. For instance in case of a U-profile, whereby the web of the U-profile is in a plane parallel to the plane formed by the X-axis and Y-axis, a hole in a flange is referenced along the Z-axis starting from the web. If the U-profile has bow, the hole in the flange would be inaccurately punched in the flange. By measuring the displacement of the profile along the Z-axis by measuring pins or measuring rolls on the web, the position of the hole in the flange can be corrected.

Multiple measuring rolls or measuring pins are especially beneficial in case a punch unit comprises multiple stamps for punching holes. These stamps can be located at different positions according to the first direction. In that case it is not possible to position the profile as such that the position along the X-axis of each hole that needs to be punched corresponds with the position along the X-axis of a single measuring pin or measuring roll. By having multiple measuring pins or measuring rolls it is possible to calculate the displacement of the profile in said direction transverse to the first direction at a position along the X-axis for every hole that need to be punched by interpolating between the displacement measured by the two nearest measuring pins or measuring rolls. Nearest is in view of the position along the X-axis. At least three measuring pins or measuring rolls are required for an accurate interpolation for typical punch units. More than six measuring pins or measuring rolls are not required to obtain an accuracy of the position of the holes in said direction transverse to the first direction of ±0.4 mm.

In a further embodiment the displacement sensor comprises two group of measuring pins or measuring rolls, wherein the two groups are positioned at opposite sides of a passage for the profile. Preferably the group is positioned at opposite sides of a passage where the profile passes between die shoes of the punch unit. Two groups of measuring pins or measuring rolls at opposite sides of a passage for the profile is especially advantageous when different holes to be punched in the profile are referenced from different sides of the profile. For instance in case of a U-profile, whereby the web of the U-profile is in a plane parallel to the plane formed by the X-axis and Y-axis, a first hole in the web can be referenced along the Y-axis starting from a first flange and a second hole in the web starting from a second flange.

In an embodiment the displacement sensor comprises servomotors for pushing the measuring pins or measuring rolls against the profile.

In an embodiment the displacement sensor comprises springs for pushing the measuring pins or measuring rolls against the profile. In this embodiment a measuring roll is preferred, because a measuring pin could potentially damage a profile when it is displaced by a clamp in the first direction.

In a preferred embodiment the displacement sensor comprises pneumatic cylinders for pushing the measuring pins or measuring rolls against the profile. In this embodiment a measuring roll is preferred, because a measuring pin could potentially damage a profile when it is displaced by a clamp in the first direction.

In an embodiment a punch unit comprises a drive. The drive is configured for displacing the punch unit in a direction transverse to the first direction. The drive comprises a servomotor. The servomotor is preferably a permanent magnet servomotor. A rotational movement of the servomotor is translated in a linear movement by a transmission. The transmission comprises a belt, gear with gear rack, a ball screw spindle or another suitable means for translating rotational motion of the servomotor to linear motion of the punch unit. Preferably the transmission comprises a ball screw spindle. A ball screw is advantageous because it introduces little friction and because it can be assembled with high precision, allowing accurate positioning of the punch unit. The positioning of the punch unit in said direction transverse to the first direction has a minimal accuracy in said direction transverse the first direction of ±0.4 mm, preferably ±0.3 mm, more preferably ±0.2 mm and even more preferably ±0.1 mm. The punch unit can be displaced over a distance of at least 100 mm, preferably at least 200 mm, more preferably at least 300 mm and even more preferably at least 400 mm. Preferably the punch unit can be displaced over a distance that is at least equal to a maximum width of different profiles to be punched by the punch unit. The punch unit comprises a linear encoder. The linear encoder is configured to measure the positioning of the punch unit in said direction transverse to the first direction. The linear encoder has a minimal measurement accuracy along said direction transverse to the first direction of ±0.04 mm, preferably ±0.03 mm, more preferably ±0.02 mm and even more preferably ±0.01 mm. The linear encoder has a measuring range from 0 mm to at least 200 mm, preferably at least 300 mm, more preferably at least 400 mm, even more preferably at least 500 mm. Preferably the linear encoder has a measuring range from 0 mm to at least equal difference between positions of flanges and/or web of different profiles to be punched by the punch unit. The measuring range is defined as the distance between a lowest and highest possible output of the linear encoder.

A punch unit comprising a drive is advantageous when punching holes in a profile with camber or bow. For instance in the case of a U-profile with camber, whereby the web of the U-profile is in a plane parallel to the plane formed by the X-axis and Y-axis, a punch unit for punching holes in the web has a drive for displacing the punch unit in a direction parallel to the Y-axis. This is especially advantageous in combination with a displacement sensor according to a previous embodiment because a measured displacement of the profile due to camber can be automatically corrected by displacing the punch unit in a direction parallel to the Y-axis. For instance in the case of a U-profile with bow, whereby the web of the U-profile is in a plane parallel to the plane formed by the X-axis and Y-axis, a punch unit for punching holes in a flange has a drive for displacing the punch unit in a direction parallel to the Z-axis. This is especially advantageous in combination with a displacement sensor according to a previous embodiment because a measured displacement of the profile due to bow can be automatically corrected by displacing the punch unit in a direction parallel to the Z-axis.

In an embodiment the infeed conveyor comprises displaceable rollers, wherein the rollers have an axis of rotation parallel to the Z-axis and wherein the rollers are displaceable in a direction parallel to the Y-axis. Preferably the displaceable rollers are connected to pneumatic cylinders. The pneumatic cylinders are configured to displace the displaceable rollers in a direction parallel to the Y-axis. This is beneficial to push with the use of the displaceable rollers for instance a U-profile, whereby the web of the U-profile is in a plane parallel to the plane formed by the X-axis and Y-axis, against a support along a side of the infeed conveyor. Said side extends in the first direction. Because the profile is pushed against the support, a reference position of the profile in a direction parallel to the Y-axis is determined. When a profile does not have camber, holes can be accurately punched on positions along the Y-axis. When a profile does have camber, displacements of the punch unit are minimal and can be determined starting from this reference.

In an embodiment the system comprises an output conveyor. The output conveyor is beneficial to remove finished profiles from a punch line to a storage. This is especially beneficial for creating a continuous punch line.

In a second aspect, the invention relates to a method for accurately punching holes in a profile.

In a preferred embodiment, the method comprises the steps of clamping a profile in a clamp of a clamp unit, displacing the profile by sliding the clamp in a first direction in a punch unit and punching at least one hole in the profile by the punch unit. The displacement of the profile in the first direction is measured with a linear encoder, comprised in the clamp unit. This is beneficial because a linear encoder measures directly the displacement of the clamp in the first direction. Therefore errors in the displacement in the first direction of the clamp, caused by tolerances in mechanical components, can be corrected by adjusting the displacement of the clamp.

In a further preferred embodiment, the displacement measurement with the linear encoder is temperature compensated. This is advantageous because the linear encoder can expand or compress depending on the temperature in a workshop, what results in measurement errors. By knowing the temperature of the linear encoder, the expansion or compression of the linear encoder can be calculated and the measurement can be temperature compensated, resulting in an accurate position of the clamp and consequently accurate punching of holes in the profile in the first direction.

In an embodiment, the method comprises the additional step before displacing the profile of detecting a beginning of the profile using a sensor. Said beginning is an end of the profile, in the longitudinal direction of the profile, closest to the punch unit. This additional step is advantageous to control the displacement of the profile by the clamp by clamping the profile at a known distance in the first direction from the beginning of the profile. Holes can be referenced in the first direction from the beginning of the profile or from the position of the clamp on the profile.

In an embodiment the method comprises the additional step of making a reference hole in the profile. The reference hole is made before displacing the profile. The reference hole is preferably in the base of the profile. The reference hole is added by drilling, punching, laser cutting or another suitable technique. The reference hole can be used as a reference position in the first direction for all the other holes that are to be punched in the profile. A reference hole is especially beneficial if the beginning of the profile is not a straight end or if the beginning of the profile is not perpendicular to the first direction.

In an embodiment the method comprises the additional step before displacing the profile of pushing the profile in a direction transverse to the first direction against a support. The support extends in the first direction. The position of the support is a reference position in a direction transverse to the first direction.

In an embodiment the method comprises the additional step of measuring a position of a longitudinal edge of the profile relative to an axis in the first direction after displacing the profile in the first direction. The axis is preferably a reference axis throughout a punch line for measuring displacements in a direction perpendicular to the first direction. The axis lies for instance in a support as described in a previous embodiment. This step is advantageous for punching holes accurately in a profile with camber or bow. When having camber or bow, the holes would be very accurately positioned in the first direction, but not in a direction transverse to the first direction. Because the displacement of the profile in said direction transverse to the first direction is measured, corrective actions can be taken and an accurate position of holes in said direction transverse to the first direction can be obtained.

For instance, in case of a U-profile, whereby the web of the U-profile is in a horizontal plane and the first direction is within said horizontal plane, holes in the web of the U-profile would not be accurately positioned in a horizontal direction perpendicular on the first direction when having camber and holes in the flanges of the U-profile would not be accurately positioned in a vertical direction of the Z-axis when having bow. The position of a longitudinal edge, being one of both flanges in case of punching holes in the web or the web in case of punching holes in one of the flanges, is measured relative to a horizontal axis, parallel to the first direction.

In a further embodiment the method comprises the additional step of adjusting the position of the punch unit in a direction transverse to the first direction after measuring said position of said longitudinal edge of the profile relative to said axis in the first direction. This is advantageous when punching holes in a profile with camber or bow. The adjustment of the position of the punch unit will result in accurate positioning of the holes in a direction transverse to the first direction.

For instance in the case of a U-profile with camber, whereby the web of the U-profile is in a horizontal plane and the first direction is within said horizontal plane, the position of a punch unit for punching holes in the web will be adjusted in a direction in the horizontal plane and perpendicular to the first direction, compensating for a difference in measured position of the longitudinal edge of the profile, being one of both flanges, relative to said axis in the first direction and an expected position of said longitudinal edge, at a position in the first direction where the holes have to be punched in the web.

For instance in the case of a U-profile with bow, whereby the web of the U-profile is in a horizontal plane and the first direction is within said horizontal plane, the position of a punch unit for punching holes in a flange will be adjusted in a vertical direction, compensating for a difference in measured position of the longitudinal edge of the profile, being the web, relative to said axis in the first direction and an expected position of said longitudinal edge, at a position in the first direction where the holes have to be punched in the flange.

In a further embodiment the method comprises the additional step of verifying said position of said longitudinal edge of the profile relative to said axis in the first direction after adjusting the position of the punch unit. This is beneficial because the displacement of the punch unit can cause vibrations or because during the displacement the punch unit could hit the profile, resulting in a displacement of the profile and an incorrect positioning of the holes in a direction transverse the first direction.

In a third aspect, the invention relates to use of a system according to the first aspect or a method according to the second aspect for punching holes in web and flanges of a U-profile for a truck or trailer chassis.

This use provides an advantageous effect that holes punched in web and flanges of a U-profile for a truck or trailer chassis are accurately positioned. This is beneficial for avoiding distortions in the chassis of the truck or trailer and for easy assembly.

Accurate positions of holes punched in web and flanges are relative to each other, allowing the use of profiles with camber and/or bow. The holes are accurately positioned in web and flanges in a first direction with a beginning of a profile as reference. The holes are accurately positioned in the web in a second direction transverse to the first direction with one of both flanges as reference. Which flange is used can change from hole to hole. Holes interacting or used for assembly of an element of the truck or trailer, for instance an engine, a reservoir or a cross beam, are preferably referenced to a same flange. The holes are accurately positioned in a flange in a third direction transverse to the first direction with the web as reference.

The use of a system according to the first aspect or a method according to the second aspect allows processing U-profiles for truck or trailers with a length of at least 4 m up to 12 m. The system allows use of a U-profile which can have a camber of at least 1 mm per 1000 mm of length with a maximum aggregated camber of 5 mm on a total length of 12 000 mm, preferably a maximum aggregated camber of 6 mm, more preferably a maximum aggregated camber of 7 mm and even more preferably a maximum aggregated camber of 8 mm. The system allows use of a U-profile which can have a bow of at least 3 mm per 2000 mm of length with a maximum aggregated bow of 8 mm on a total length of 12 000 mm, preferably a maximum aggregated bow of 9 mm, more preferably a maximum aggregated bow of 10 mm and even more preferably a maximum aggregated bow of 11 mm.

It is clear that the method according to the invention, and its applications, are not limited to the presented examples.

It is clear for a person of ordinary skill in the art that a system according to the first aspect is preferably configured for executing a method according to the second aspect and that a method according to the second aspect can be executed using a system according to the first aspect. Every characteristic, described in this document, above as below, can be applicable to each of the three aspects of the current invention.

The invention is further described by the following non-limiting FIGURE which further illustrates the invention, and is not intended to, nor should it be interpreted to, limit the scope of the invention.

DESCRIPTION OF FIGURES

FIG. 1 shows a schematic overview of a punch line comprising a system according to an embodiment of the present invention.

The punch line depicted in FIG. 1 is suitable for punching U-profiles for trucks or trailers. The punch line is placed on a floor surface (1). The punch line comprises an infeed conveyor (2). The infeed conveyor (2) extends along a first direction, corresponding to the direction of the X-axis. Profiles (3) extend in a longitudinal direction. The profiles (3) are U-profiles. The profiles (3) are processed in the punch line, whereby the longitudinal direction of the profiles (3) is parallel with the X-axis. The infeed conveyor (2) comprises a support (4). A profile (3) is pushed in a direction parallel with the Y-axis against the support (4). This gives a reference position for a profile (3) in a direction transverse to the first direction, being the direction of the Y-axis. The punch line comprises a first and second sensor (5) for detecting a beginning of a profile (3). The sensor (5) gives a reference position for a profile (3) in the first direction. The sensor is placed near a punch unit (10). A profile (3) is passed from the infeed conveyor (2) to a clamp unit (6). The clamp unit (6) comprises a clamp (8) and a linear encoder (7). The clamp unit (6) comprises a temperature sensor (22) for measuring the temperature of the linear encoder (7). The clamp (8) is slideable along the direction of the X-axis. The clamp (8) can be accurately positioned on a support structure of the clamp unit (6) using measurements from a linear encoder (7). The temperature sensor (22) enables temperature compensated measurements from the linear encoder (7). The clamp (8) is configured to displace a profile (3) in a punch unit (10). Because the position of the clamp (8) can be accurately determined and the beginning of a profile (3) is determined with sensor (5), a profile (3) can be positioned accurately in punch unit (10) to punch holes at a position along the first direction. The clamp (8) comprises a slippage sensor (9) comprising a magnet. The magnet of the slippage sensor (9) is magnetically attracted to a profile (3). The slippage sensor (9) is beneficial to detect slippage of a profile (3) in the clamp (8) when for instance a profile (3) hits the punch unit (10) when entering the punch unit (10) or when transferring a profile (3) from clamp (8) to clamp (13) of an intermediate clamp unit (12). Punch unit (10) is configured for punching holes in the web of a profile (3). For compensating for camber of profile (3), punch unit (10) comprises a displacement sensor (17), comprising two groups of three measuring wheels, coupled to linear encoders. The two groups are positioned at opposite sides of a passage for the profile (3) in punch unit (10). The measuring wheels of the displacement sensor (17) are pushed against flanges of a profile (3). The displacement of the measuring wheels are measured with the linear encoders coupled with the displacement wheels. The measurements are corresponding to a displacement of a profile (3) in the direction of the Y-axis relative to the support (4) due to camber. Punch unit (10) is followed by a second punch unit (11). The punch unit (11) is similar to punch unit (10). Punch unit (11) is added due to the high number of holes that have to be punched in the web of profile (3). When exiting punch unit (11), a profile (3) is taken over by clamp (13) of the intermediate clamp unit (12). The clamp (13) clamps a profile (3) while the clamp (8) is still clamping profile (3) and while clamp (8) is stationary. Clamp (13) is at that moment also stationary. Clamp (8) releases profile (3) when clamp (13) successfully clamped profile (3). Because the position of clamp (8) and clamp (13) are accurately know known, positions in the direction of the X-axis of holes in a profile (3) can be referenced to the position of clamp (13) during take-over. Eventual slippage in a clamp during take-over can be compensated by use of a slippage detector (9). Clamp (13) is displacing a profile (3) into punch unit (14).

Punch unit (14) is configured for punches holes in a first flange of a profile (3). For compensating for bow of profile (3), punch unit (14) comprises a displacement sensor (18), comprising one group of three measuring wheels, coupled to linear encoders. The group is positioned at a passage for the profile (3) in punch unit (14). The measuring wheels of the displacement sensor (18) are pushed against the web of a profile (3). The displacement of the measuring wheels are measured with the linear encoders coupled with the displacement wheels. The measurements are corresponding to a displacement of a profile (3) in the direction of the Z-axis due to bow. The reference for displacement in the direction of the Z-axis is an axis through the support (4) at a height of rollers of infeed conveyor (2) on which the web of a profiles (3) lies. This axis is also indicated on the drawing with a dashed line. Punch unit (14) is followed by punch unit (15). Punch unit (15) is similar to punch units (10) and (11). Punch unit (15) can punch holes with a different diameter than punch units (10) and (11). Punch unit (15) is followed by punch unit (16). Punch unit (16) is similar to punch unit (14). Punch unit (16) is added to punch holes in a second flange of profile (3). When exiting punch unit (16), profile (3) is taken over by clamp (20) of a second clamp unit (19). Taking over is happening similarly as described before. Clamp (19) is used both for accurately positioning profile (3) for punching holes, as well as for delivering profile (3) to output conveyor (21). Output conveyor (21) removes finished profiles (3) from the punch line to a storage.

The invention claimed is:

1. A system for accurately punching holes in a profile comprising:

at least one clamp unit, comprising a clamp, slideable in a first direction, and at least one punch unit for punching holes in a profile, characterized in that, the at least one clamp unit comprises a linear encoder, configured for measuring a displacement of the clamp of the at least one clamp unit in the first direction, and a temperature sensor configured for measuring the temperature of the linear encoder; and the at least one punch unit comprises a displacement sensor comprising a linear encoder configured for measuring a displacement of the profile in a direction transverse to the first direction, relative to an axis in the first direction.

2. The system according to claim 1, wherein the system comprises at least two clamp units, each clamp unit comprising a clamp slideable in the first direction, wherein the at least one punch unit is positioned in between two of the at least two clamp units and wherein each of the two of the at least two clamp units comprises a linear encoder, configured for measuring a displacement of the clamp of the at least two clamp units in the first direction.

3. The system according to claim 1, wherein the at least one clamp unit comprises a slippage sensor configured for detecting slippage of the profile in the clamp of the at least one clamp unit, wherein the slippage sensor comprises a magnet configured for magnetic attraction to a magnet reference position on the profile, wherein slippage of the profile in the clamp of the at least one clamp unit displaces the magnet to a new position on the profile, wherein the slippage sensor comprises means for measuring the displacement of the magnet in the first direction between the magnet reference position and the new position, thereby measuring the amount of the slippage.

4. The system according to claim 3, wherein the slippage sensor comprises an arm, having a first and a second end, wherein the arm is at the first end attached to an attachment point on the clamp, wherein the arm comprises the magnet at the second end, and wherein the magnet is moveable relative to the attachment point of the clamp.

5. The system according to claim 1, wherein the displacement sensor comprises a group of at least three measuring wheels, wherein each measuring wheel is coupled to a corresponding linear encoder, wherein the measuring wheels of the group are equidistantly spread along an axis in the first direction, and wherein the group is positioned at a passage for the profile.

6. The system according to claim 1, wherein the at least one punch unit comprises a drive, configured for displacing the punch unit in a direction transverse to the first direction.

7. A method for accurately punching holes in a profile comprising:

clamping a profile in a clamp of a clamp unit, displacing the profile in a punch unit by sliding the clamp in a first direction, measuring a position of a longitudinal edge of the profile in a direction transverse to the first direction, relative to an axis in the first direction, with a linear encoder comprised in a displacement sensor of the punch unit, and punching at least one hole in the profile by the punch unit, characterized in that, the displacement of the profile in the first direction is measured with a linear encoder and the temperature of the linear encoder is measured by a temperature sensor, comprised in the clamp unit.

8. The method according to claim 7, wherein, the displacement measurement with the linear encoder is temperature compensated.

9. The method according to claim 7 an additional step of verifying said position of said longitudinal edge of the profile relative to said axis in the first direction after adjusting the position of the punch unit.

10. The method according to claim 7, wherein the method comprises an additional step of making a reference hole in the profile.

11. The method according to claim 7, wherein the profile is a U-profile for a truck or trailer chassis, and wherein the punching at least one hole in the profile by the punch unit comprises punching at least one hole in a web and/or one or more flanges of the U-profile.

* * * * *